US006511142B1

(12) United States Patent
Carmon et al.

(10) Patent No.: US 6,511,142 B1
(45) Date of Patent: Jan. 28, 2003

(54) INK CARTRIDGE

(75) Inventors: Amiram Carmon, Jerusalem; Yoel Amir, Kfar Saba; Gil Fisher, Petach Tikva, all of (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/486,221

(22) PCT Filed: Aug. 23, 1998

(86) PCT No.: PCT/IL98/00339

§ 371 (c)(1),
(2), (4) Date: Feb. 24, 2000

(87) PCT Pub. No.: WO99/10180

PCT Pub. Date: Mar. 4, 1999

(30) Foreign Application Priority Data

Aug. 27, 1997 (IL) ..... 121640

(51) Int. Cl.[7] ..... B41J 2/195; B41J 2/175; B65D 47/02

(52) U.S. Cl. ..... 347/7; 347/86; 222/147

(58) Field of Search ..... 347/85, 86, 87, 347/7; 222/147

(56) References Cited

U.S. PATENT DOCUMENTS

| | | | | |
|---|---|---|---|---|
| 4,604,633 A | | 8/1986 | Kimura et al. | |
| 4,710,177 A | * | 12/1987 | Smith et al. | 604/185 |
| 4,961,088 A | | 10/1990 | Gilliland et al. | |
| 5,138,344 A | | 8/1992 | Ujita | |
| 5,157,421 A | | 10/1992 | Kitahara | |
| 5,381,172 A | | 1/1995 | Ujita et al. | |
| 5,619,424 A | | 4/1997 | Cookson et al. | |
| 5,666,146 A | | 9/1997 | Mochizuki et al. | |
| 5,971,533 A | * | 10/1999 | Kinoshita et al. | 347/86 |
| 6,109,743 A | * | 8/2000 | Takatsugi et al. | 347/86 |

FOREIGN PATENT DOCUMENTS

| | | |
|---|---|---|
| DE | 41 04 786 A1 | 9/1991 |
| EP | 0 437 363 B1 | 7/1991 |
| EP | 0 560 398 B1 | 9/1993 |
| EP | 0 661 160 A3 | 7/1995 |
| EP | 0 661 160 A2 | 7/1995 |
| JP | 9267484 | 10/1997 |

* cited by examiner

*Primary Examiner*—Michael Nghiem
(74) *Attorney, Agent, or Firm*—Eitan, Pearl, Latzer & Cohen-Zedek

(57) ABSTRACT

An ink cartridge is provided which includes a rigid housing and a flexible ink storage bag inserted within the housing. The storage bag, which is connectable to the ink supply line of a printer by a hollow needle, is impenetrable by the needle or similar when the storage bag is depleted of ink.

12 Claims, 12 Drawing Sheets

INK CARTRIDGE

FIELD OF THE INVENTION

The present relates to replaceable ink cartridges used with inkjet printers in general and to the preventing the use of non-genuine ink cartridges in particular.

BACKGROUND OF THE INVENTION

Inkjet printers use cartridges filled with ink for the production of the printed pages. Except for printing paper these cartridges are the major consumable item used with the printers and need replacing on a regular basis. It is in the interest of the printer manufacturers to ensure that only their own original replacement cartridges are used. However, there is a large secondary market for the ink itself either sold on it's own for the consumer to fill the used up cartridge and for non-original replacement cartridges refilled with ink by those ink-manufacturers. These non-original ink sources can cause malfunction of the printer or even permanent damage.

Manufactures of thermal bubble print heads utilize expendable cartridges which include the thermal head as part of the cartridge. The thermal head as well as the cartridge is thus disposable, and can not be reused.

Alternatively, other printers use heads which are a permanent part of the printer. The type of cartridge used with permanent head printers comprises an ink bag for storing the recording ink. U.S. Pat. No. 5,157,421 to Kithara and EP Patent No. EP 0 661 160 to Nishioka, for example, describe replaceable ink jet cartridges for use with ink jet printers.

A disadvantage of ink bags (from the manufacturer's point of view) is that they are relatively easy to refill and imitate. The manufactures of original equipment are, thus interested in preventing other sources from refilling the cartridges and copying or faking their original cartridges.

SUMMARY OF THE INVENTION

An object of the present invention is to provide an ink cartridge which cannot be tampered with and which cannot be refilled by outside sources, thereby overcoming the limitations and disadvantages of existing cartridges.

A further object of the present invention is to provide an ink cartridge whose authenticity can be checked so as to deter the production of non-authorized copies.

There is thus provided, in accordance with a preferred embodiment of the present invention, an ink cartridge which includes a rigid housing and a flexible ink storage bag inserted within the housing. The storage bag is connectable to the ink supply line of a printer by means of a hollow needle. The storage bag is impenetrable by the needle or similar when the storage bag is depleted of ink.

Furthermore, in accordance with a preferred embodiment of the present invention, the housing includes upper and lower chambers connectable together. In addition, the housing further includes an outlet port for connecting the housing to the printer.

Furthermore, in accordance with a preferred embodiment of the present invention, the hollow needle includes an angled sealed point formed in one end thereof.

Furthermore, in accordance with a further preferred embodiment of the present invention, the ink cartridge includes a metal element placed on top of the ink storage bag so that the metal element descending as the ink storage bag is emptied. In addition the metal element includes an annulus formed therein and is also composed of a ferrous material.

Furthermore, in accordance with a further preferred embodiment of the present invention, the printer includes a magnetic sensor proximate to the bottom of the lower chamber for sensing the presence of the ferrous metal element thereby to indicate the depletion of the storage bag.

In addition, in accordance with a further preferred embodiment of the present invention, the ink cartridge further includes an indicator representing a logo attached to the exterior face of the housing. The indicator is composed of conductive material responsive to electro-magnetic fields and the printer includes a detector for detecting the form of the indicator.

Preferably, the detectable metal logo is placed on a mechanically formed raised or recessed shape of the logo, and a negative shape is included in the housing of the printer. Thus, it is necessary to insert the raised mechanical form into the recessed mechanical form of the logo, in order to fit the cartridge to the printer.

Furthermore, the ink cartridge includes a processing unit which may be coupled to the central processing unit of the printer.

Additionally, there is also provided, in accordance with a preferred embodiment of the present invention, a method for verifying the authenticity of an ink cartridge. The ink cartridge has a processing unit coupled thereto and the method includes the steps of:

a) installing and connecting the ink cartridge to a printer having a central processing and control unit (CPU) connected thereto;

b) the CPU sending a randomly generated number ("code") to the installed ink cartridge;

c) the CPU performing a first encryption algorithm on the code;

d) the cartridge processing unit performing a second encryption algorithm on the code;

e) comparing the resulting first and second encryption algorithms; and f) indicating an error if the resulting first and second encryption algorithms are not identical.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
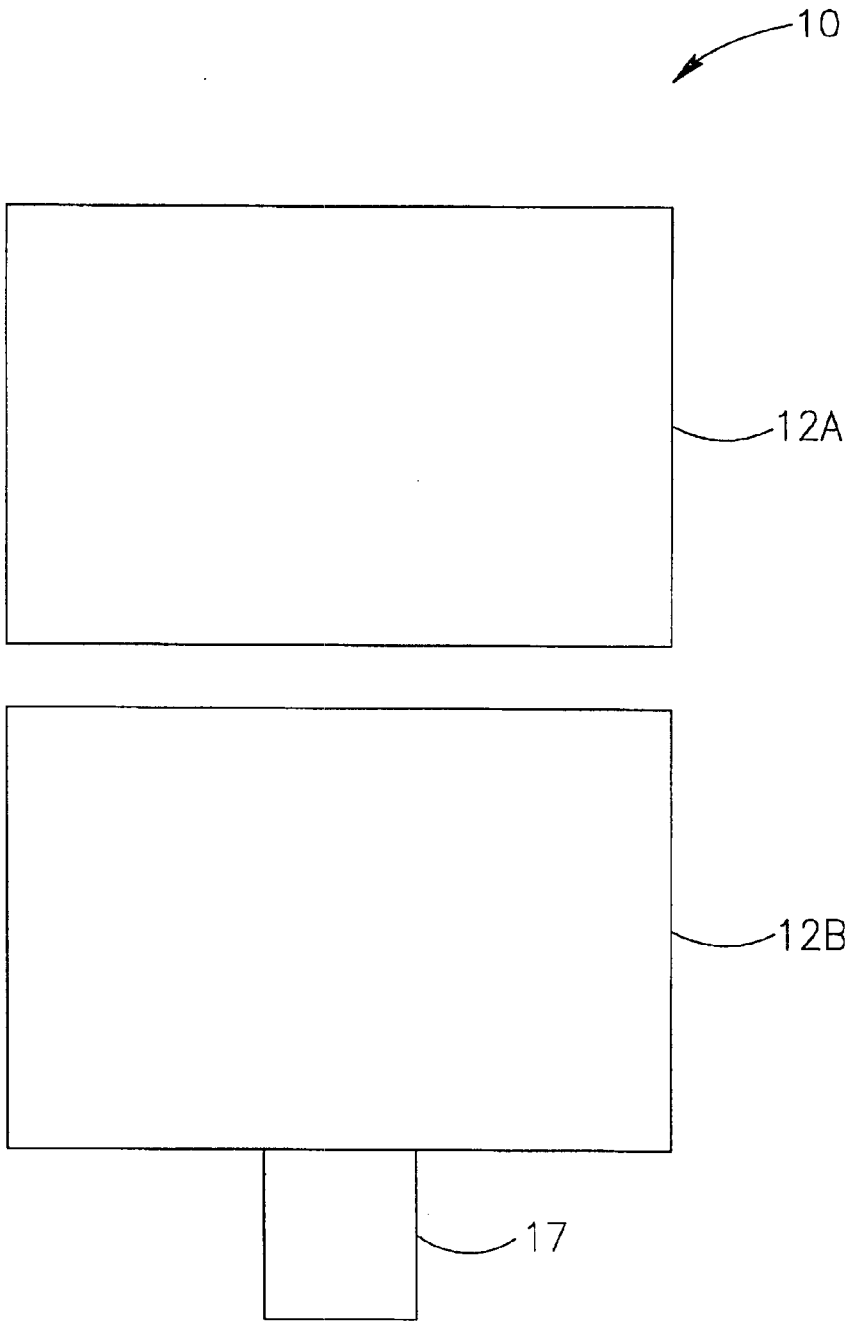
FIG. 1 is an illustration of an ink cartridge, according to a preferred embodiment of the present invention.
Figure 2A:
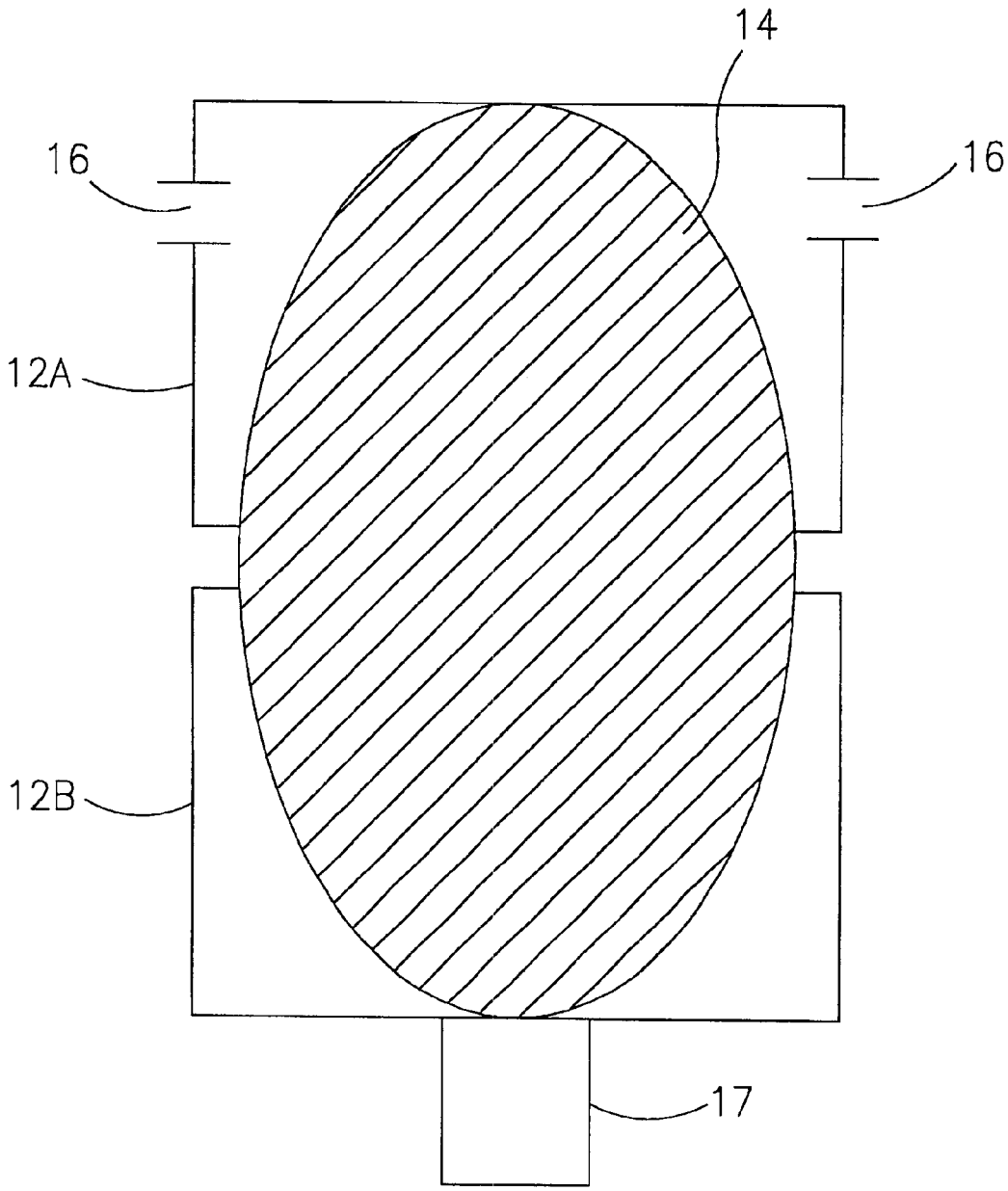
FIGS. 2A and 2B are cross sectional illustrations of the ink bag within the ink cartridge of FIG. 1.
Figure 2B:
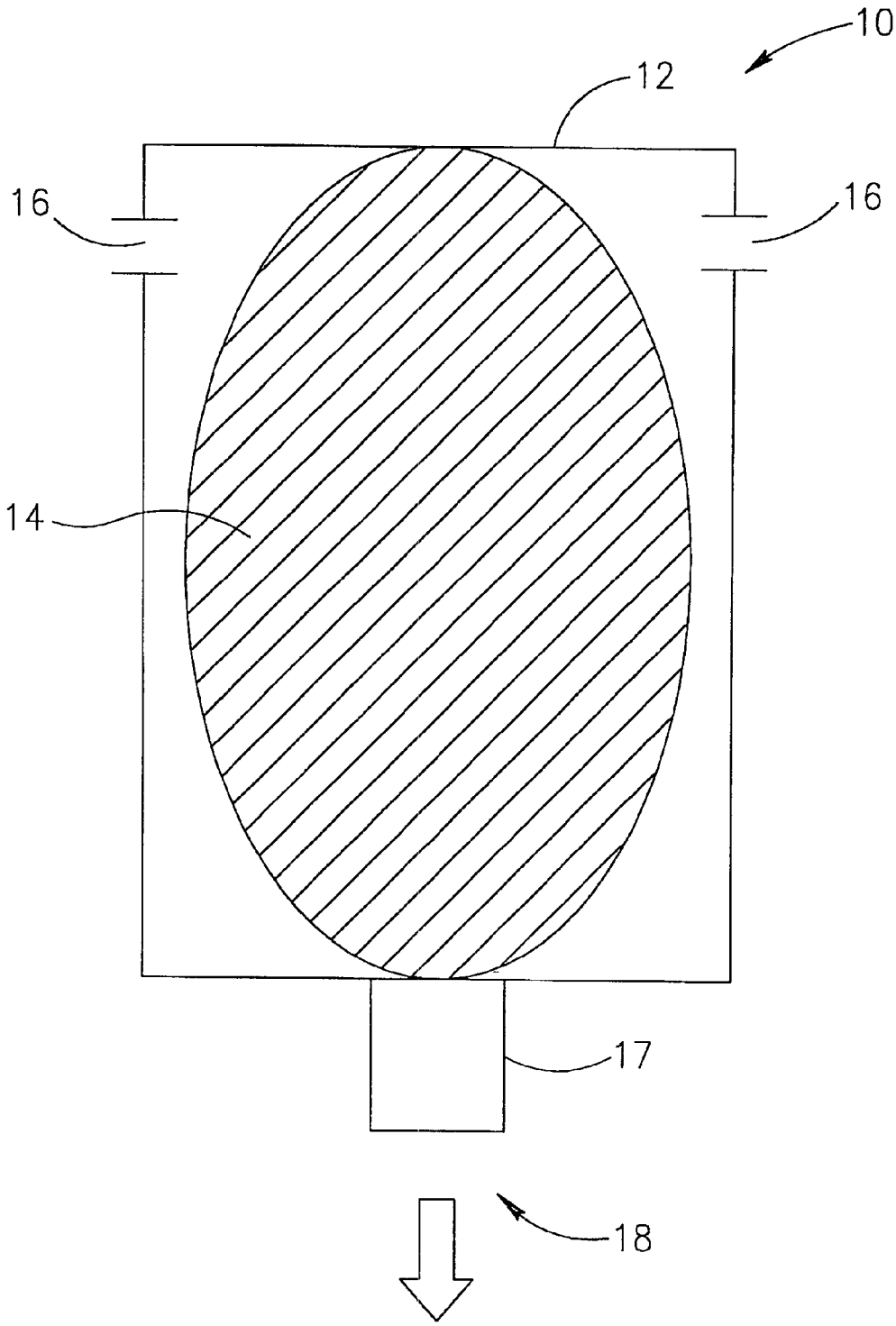

Reference is now made to FIG. 1 which is an illustration of an ink cartridge, generally designated 10, according to a preferred embodiment of the present invention. Cartridge 10 comprises a rigid housing 12 having upper and lower chambers, referenced 12*a* and 12*b*, respectively, into which an ink-filled bag 14 is placed. As best seen in FIGS. 2A and 2B, to which referenced is now also made, the ink-filled bag 14 is placed in the lower chamber 12*b* of the cartridge 10 and the upper chamber 12*a* is placed over the bag 14 (FIG. 2A). The upper and lower chambers, 12*a* and 12*b,* respectively, of the cartridge 10 are glued together, or closed in any other way, which renders housing 12 as one unit. The lower chamber 12*b* comprises a neck 17, integrally formed therewith, which acts as the outlet port 18 for the ink within the bag 14. Neck 17 facilitates the connection of cartridge 10 to the printing mechanism (not shown). The rigid housing 12 comprises a plurality of puncture holes 16, to keep the inner part at atmospheric pressure.

The bag 14 is filled with ink, prior to being inserted into the cartridge 10, by any known method, such as inserting a syringe into the top of the bag 14, filling with ink and then sealing the hole made by the syringe. The full bag 14 has a generally oval shape (FIG. 2A) which is compressed into a generally spherical shape (FIG. 2B) on being locked into the rigid housing 12.

The ink bag 14 is comprised of any suitable flexible material, such as latex rubber, plastics or aluminum foil.

Figure 3A:
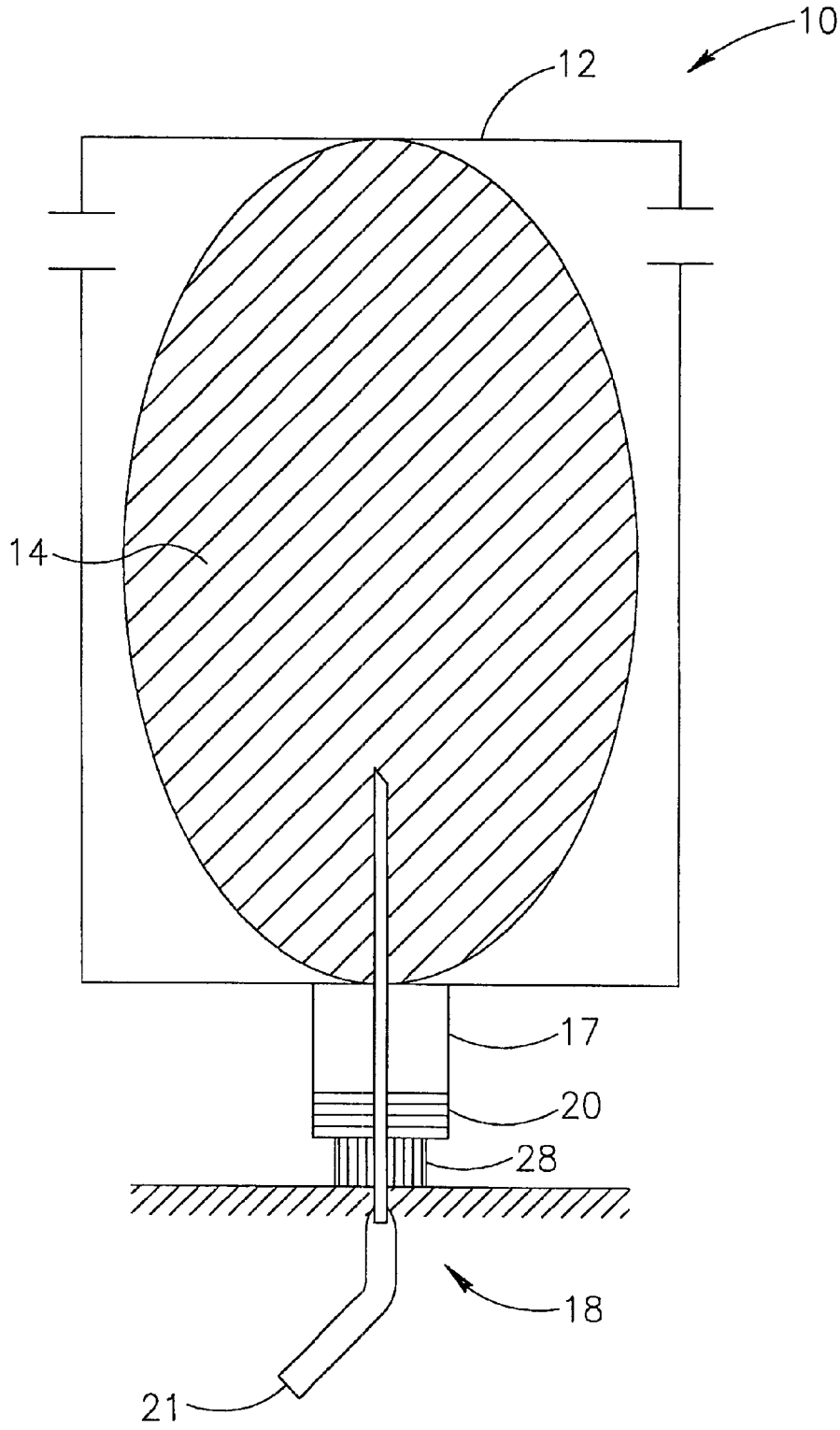
FIGS. 3A and 3B are detailed illustrations of the outlet port of the ink cartridge of FIG. 1.
Figure 3B:
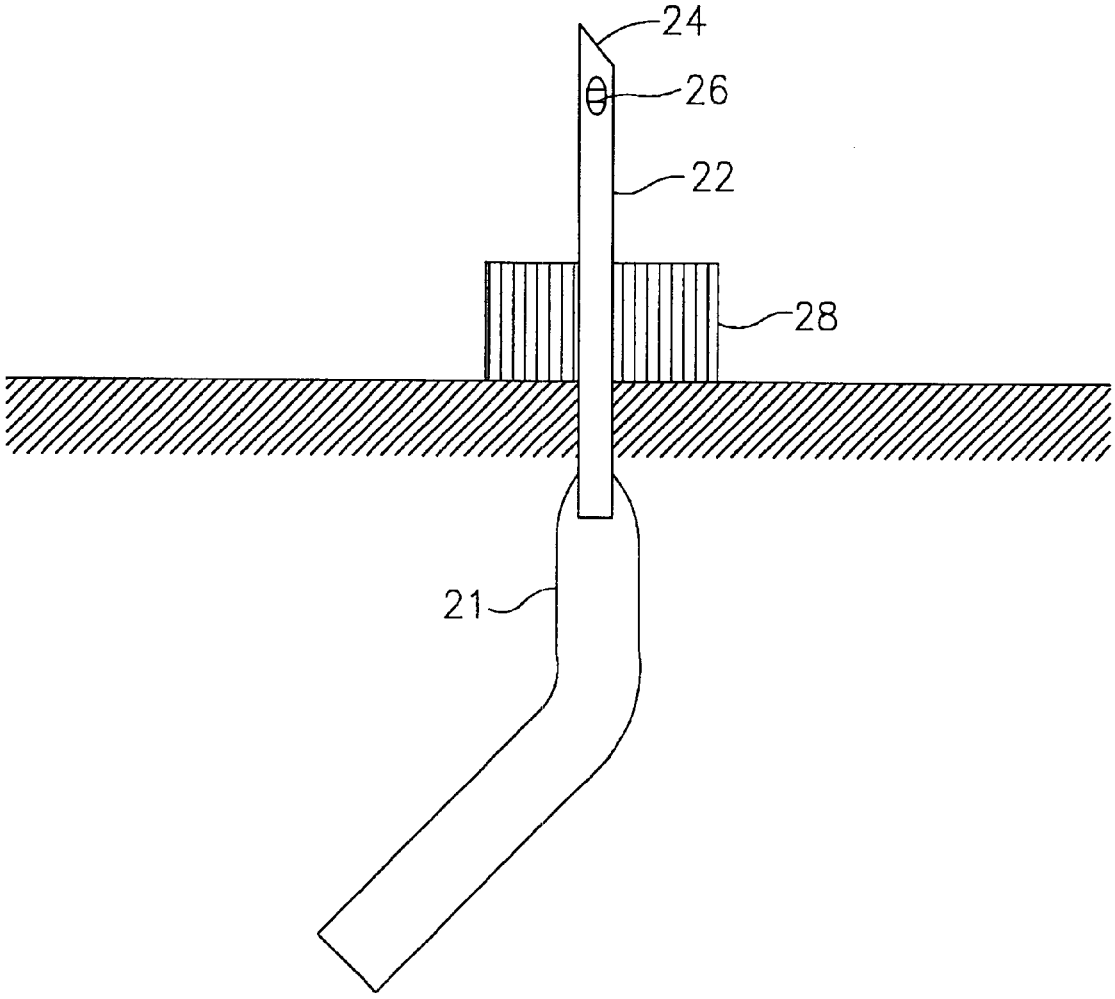

Reference is now also made to FIGS. 3A and 3B which schematically illustrate the outlet port 18. A rubber plug 20, or similar device, is suitably inserted and fixed within the outlet port 18 (neck 17 of cartridge 10) to act as a seal.

Outlet port 18 is connectable to the ink-supply line 21 of the jet printing mechanism (not shown). Ink-supply line 21 comprises a fixed hollow needle 22 having an angled sealed point 24 formed in one end thereof, which penetrates bag 14 through plug 20 to feed the ink to the printer once the cartridge 10 is inserted. An aperture 26, which is formed proximate to point 24, acts as entry point for the ink and prevents the formation of air bubbles. The penetration of needle 22 into the bag 14 is facilitated by the fact that the bag is full of ink and tightly enclosed in housing 12.

A stopper 28 is fixed around needle 22. The position of stopper 28 on needle 22 determines how deeply the needle 22 penetrates the bag 14.

Figure 4:
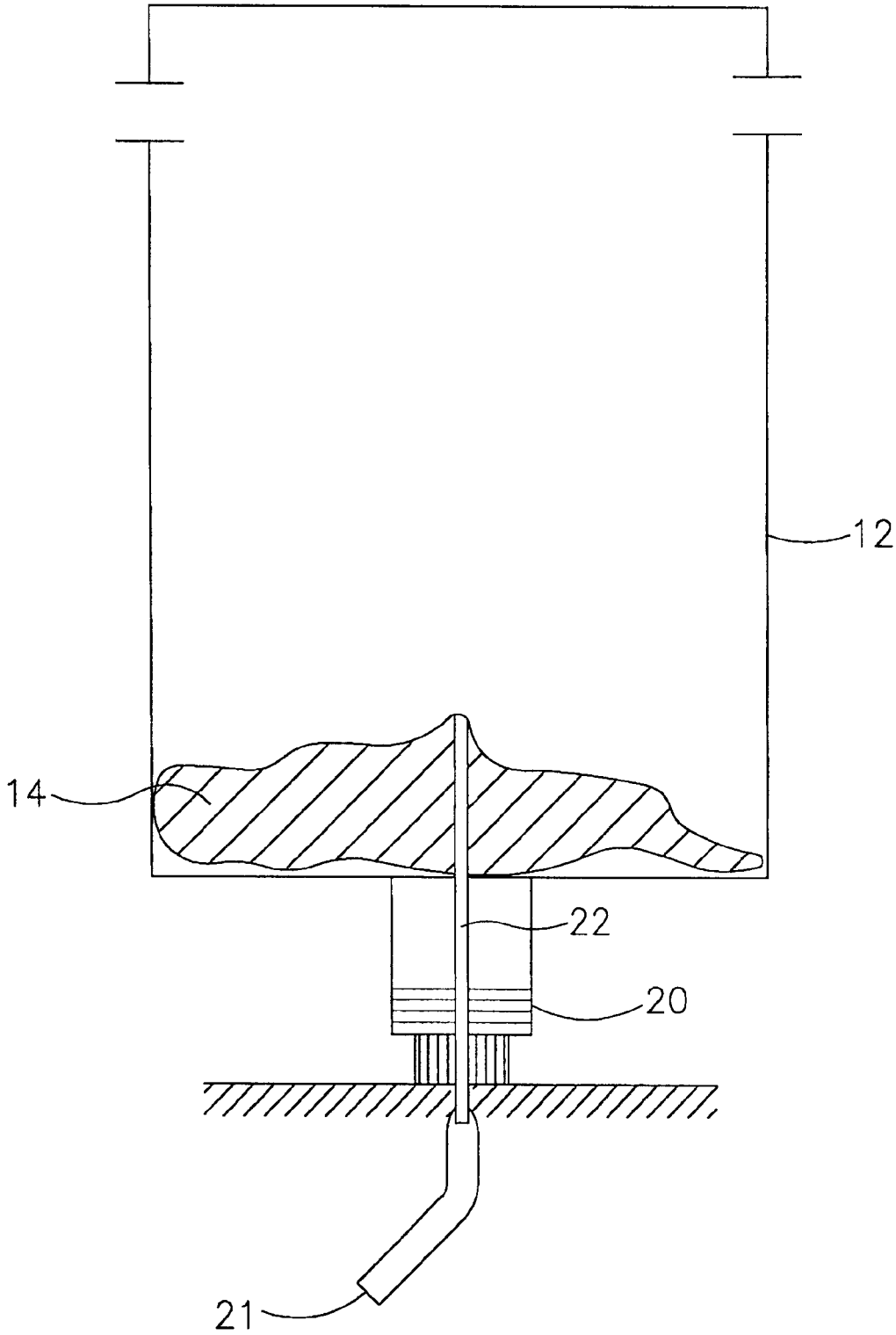
FIG. 4 is a cross sectional illustration of an almost emptied ink cartridge of FIG. 1.

In operation, as the ink is drawn off (by force of gravity), the bag 14 gradually collapses until it rests on top of the needle 22, as shown in FIG. 4, with a small quantity of ink still within the bag 14. Once the supply of ink has been exhausted, the cartridge 10 is pulled upwards away from needle 22 and discarded. Plug 20 prevents any remaining ink from leaking out of the bag 14.

Once the bag has been depleted of ink, it cannot be refilled since the depleted ink bag 14 is in a collapsed state, and any filling needle will not be able to penetrate the flexible bag.

Figure 5:
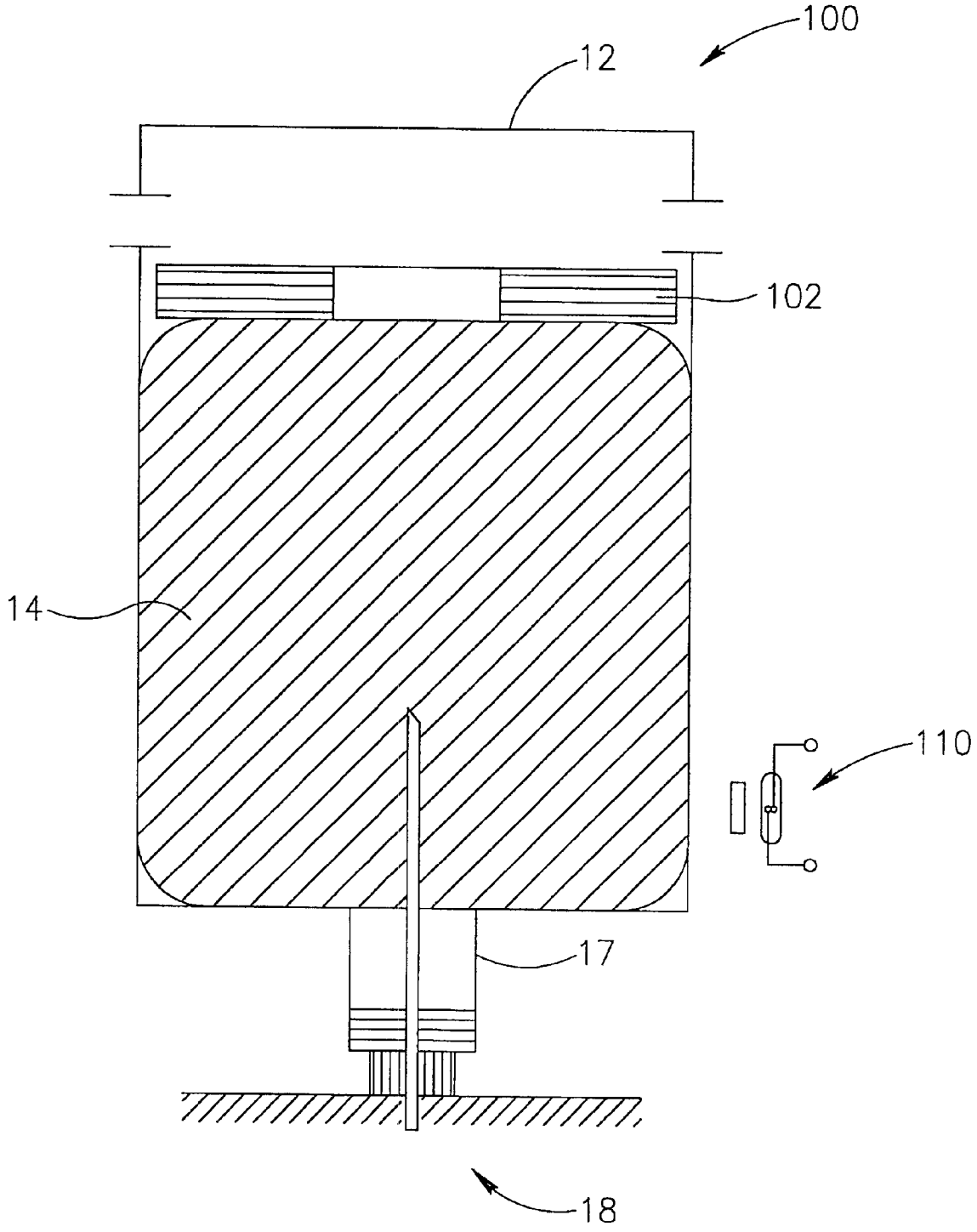
FIG. 5 is a cross sectional illustration of an ink cartridge, according to a further preferred embodiment of the present invention.

Reference is now made to FIG. 5 which is a cross sectional illustration of an ink cartridge, generally designated 100, in accordance with a further embodiment of the present invention.

Elements of this embodiment of the invention which are similar to elements which have been previously described with respect to the preferred embodiment hereinabove, are similarly designated and will not be further described.

Ink cartridge 100 comprises a rigid housing 12 into which an ink-filled bag 14 is placed. Housing 12 comprises a neck 17, integrally formed therewith, to facilitate the connection of cartridge 100 to the printing mechanism (not shown).

Ink cartridge 100 further comprises a metal disc 102 which is placed on top of the full ink bag 14, prior to the housing 12 being closed.

Metal disc 102 is preferably composed of a ferrous material having magnetic properties. The presence of metal disc 102 increases the vertical pressure on the ink bag 14 thereby improving the efficiency of the ink flow to the printer.

Furthermore, metal disc 102 can be used in conjunction with a magnetic sensor, generally designated 110 (best seen in FIGS. 6A and 6B), connected to the printing control. Magnetic sensor 110 indicates to the printer when the cartridge 100 requires to be changed.

Figure 6A:
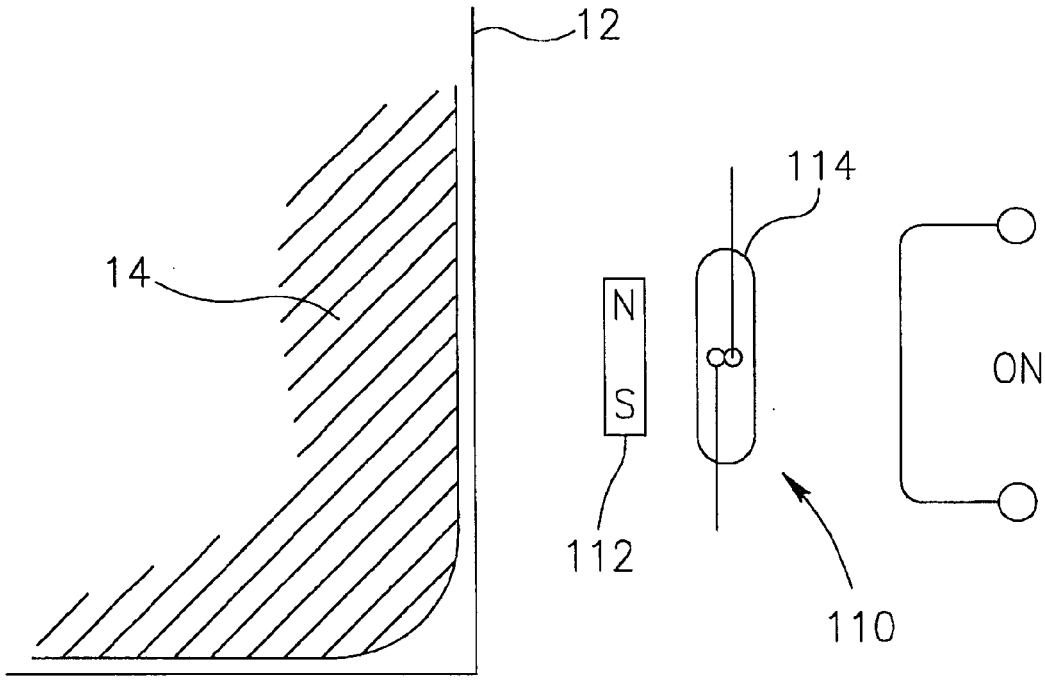
FIGS. 6A and 6B are enlarged cross sectional details of the ink cartridge of FIG. 5.
Figure 6B:
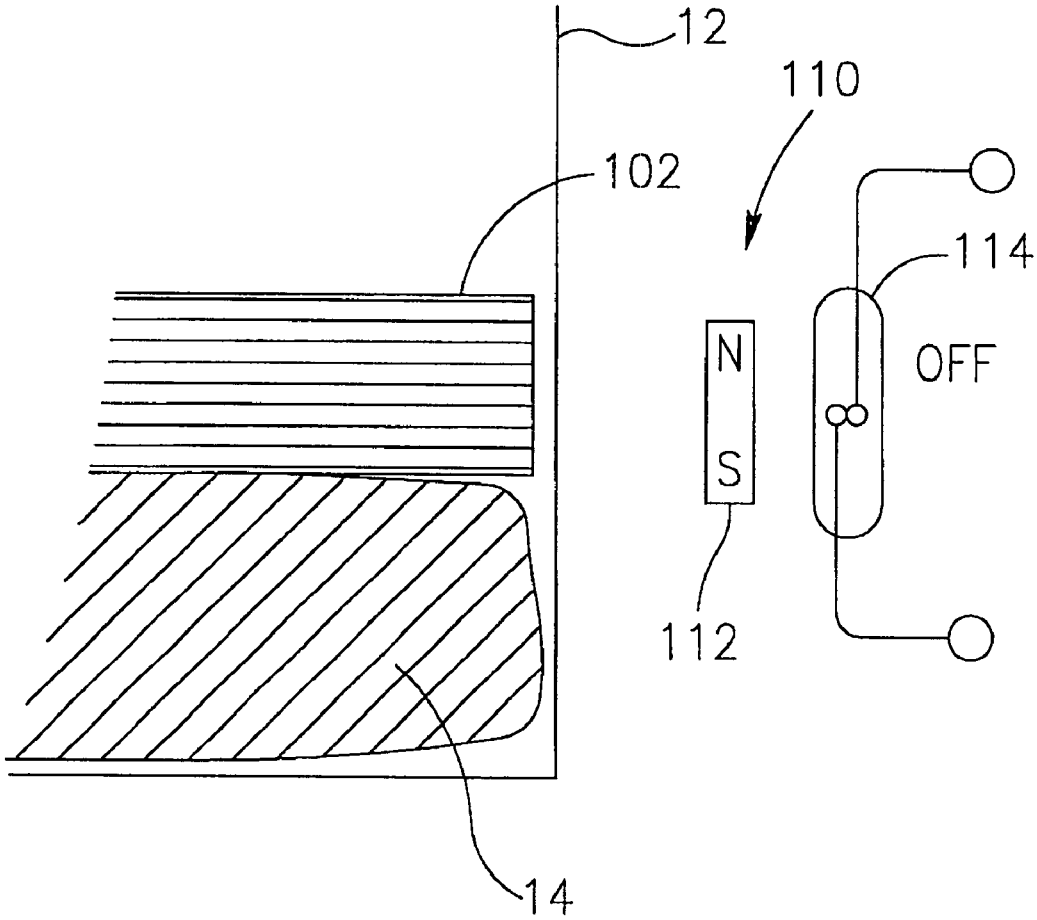

Reference is now made to FIGS. 6A and 6B, which illustrate the operation of the magnetic sensor 110. Magnetic sensor 110 can be any suitable sensor known in the art, such as the reed-relay type sensor and generally comprises a magnet 112 coupled to a reed switch 114.

FIG. 6A illustrates the ink bag 14 in a filled state. In this case, the metal element 102 is far from magnetic sensor 110, which is closed indicating an "on" state.

As the bag 14 empties of ink, the metal element 102 descends until it reaches its lowest position resting on an almost empty bag 14 (FIG. 6B). In this position, metal element 102 lies proximate to magnetic sensor 110. Magnetic sensor 110 registers the presence of metal element 102 and de-activates the switch 114 indicating an "off" or "empty" signal.

Figure 7:
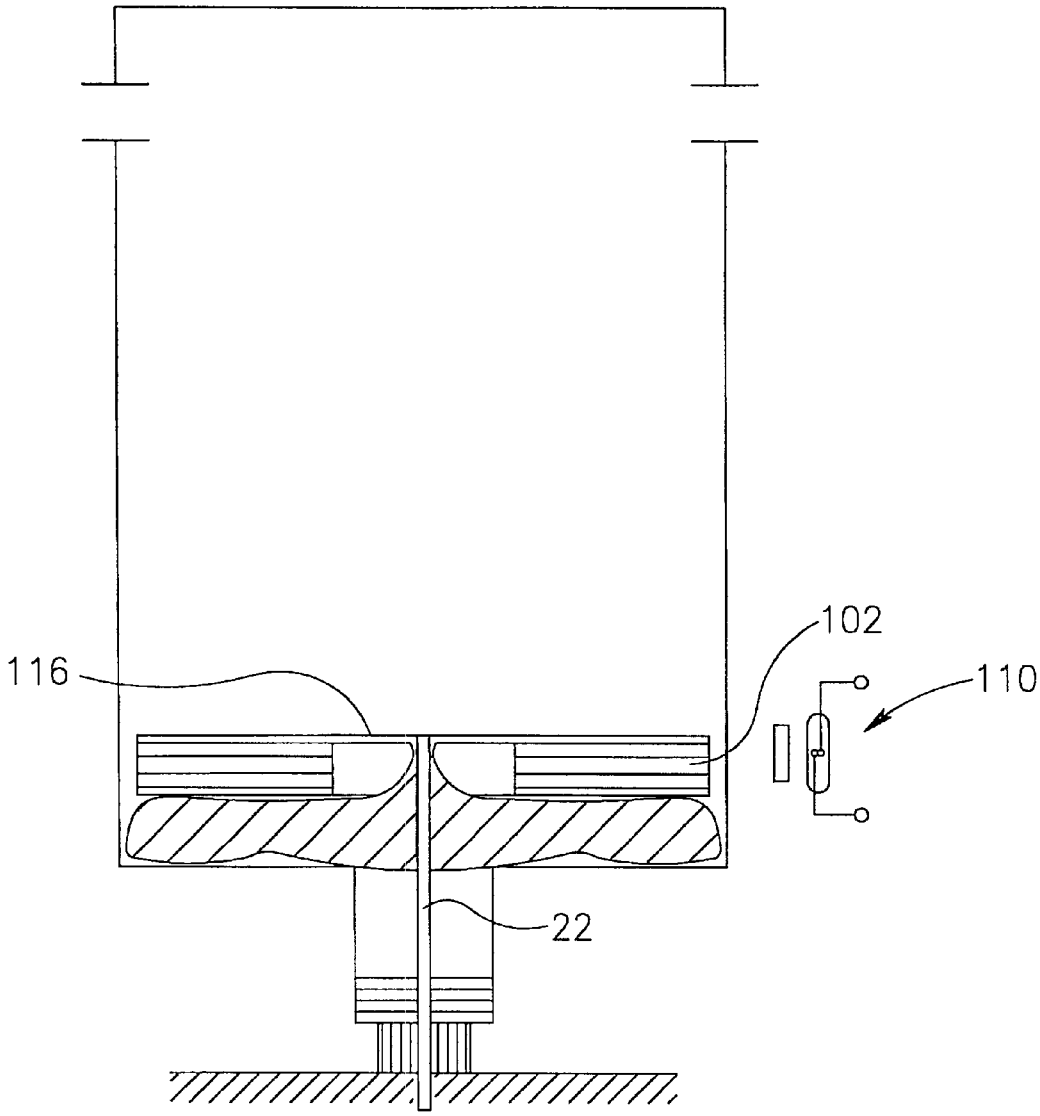
FIG. 7 is a cross sectional illustration of an almost emptied ink cartridge of FIG. 5.

Metal element 102 comprises an annulus 116 formed in the middle thereof. Consequently, as is best seen in FIG. 7, to which reference is now also made, the sharp point 24 of needle 22 again punctures the ink bag 14, thereby rendering the bag 14 unusable.

Figure 8:
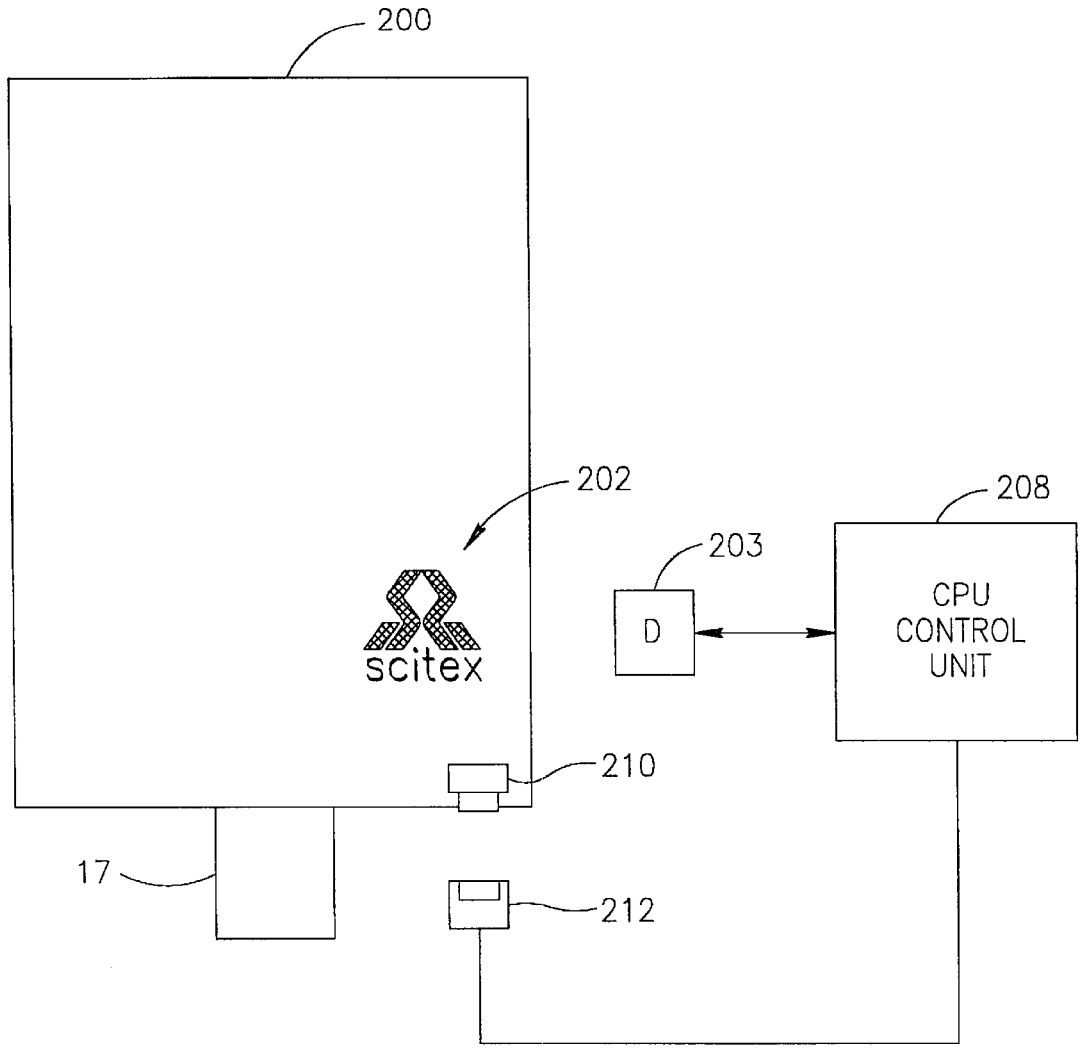
FIG. 8 is a cross sectional illustration of an ink cartridge, according to a further preferred embodiment of the present invention.

Reference is now made to FIG. 8 which illustrates a further embodiment of an ink cartridge, generally designated 200, according to a preferred embodiment of the present invention.

Elements of this embodiment of the invention which are similar to elements which have been previously described with respect to the preferred embodiments hereinabove, are similarly designated and will not be further described.

Ink cartridge 200 which may be similar either ink cartridge 10 or 100, described hereinabove, further comprises an exterior indicating element 202 attached to the housing 12 of cartridge 200. Indicating element 202 may be a sticker or painted symbol showing the trade mark of the supplier, and is preferably composed of a conductive paint or similar material on a white painted background.

The printing mechanism comprises a detector 203 which can detect the geometric form of element 202 and match R in CPU 208 to the original dimensions and form of the supplier's logo or trademark. Detector 203 can operator on basis of known methods of conductivity detection or by non-contact optical scanning, operating similar to hand held text readers.

The printer can be configured to sound an alarm and shut down, for example, if a forged or missing indicator 202 is detected. Thus, only a genuine cartridge, properly marked, would be usable with a specific printer.

Alternatively, a relief of the logo or trademark is formed on the cartridge with the corresponding negative of the logo or trademark formed on housing of the printer. Both parts of the logo (relief and its negative) must match to enable the cartridge to be properly connected to the printer.

It will be appreciated by persons knowledgeable in the art that the use of a conductive indicating element detectable by a detector means or a relief indicator are given by way of example only and is not restricted thereto.

Preferably, ink cartridge 200 further comprises a processing unit 210, preferably having read/write memory such as an EEPROM unit for storing identification data related to the cartridge 200. The cartridge 200 can be coupled by means of a suitable connector 212 to the CPU and control unit 208 inside the printer. The encryption data stored in processing unit 210 can be used to detect whether the cartridge unit being installed is genuine. Preferably, processing unit 210 is suitably installed in the cartridge so that any attempt to remove it will destroy it.

Figure 9:
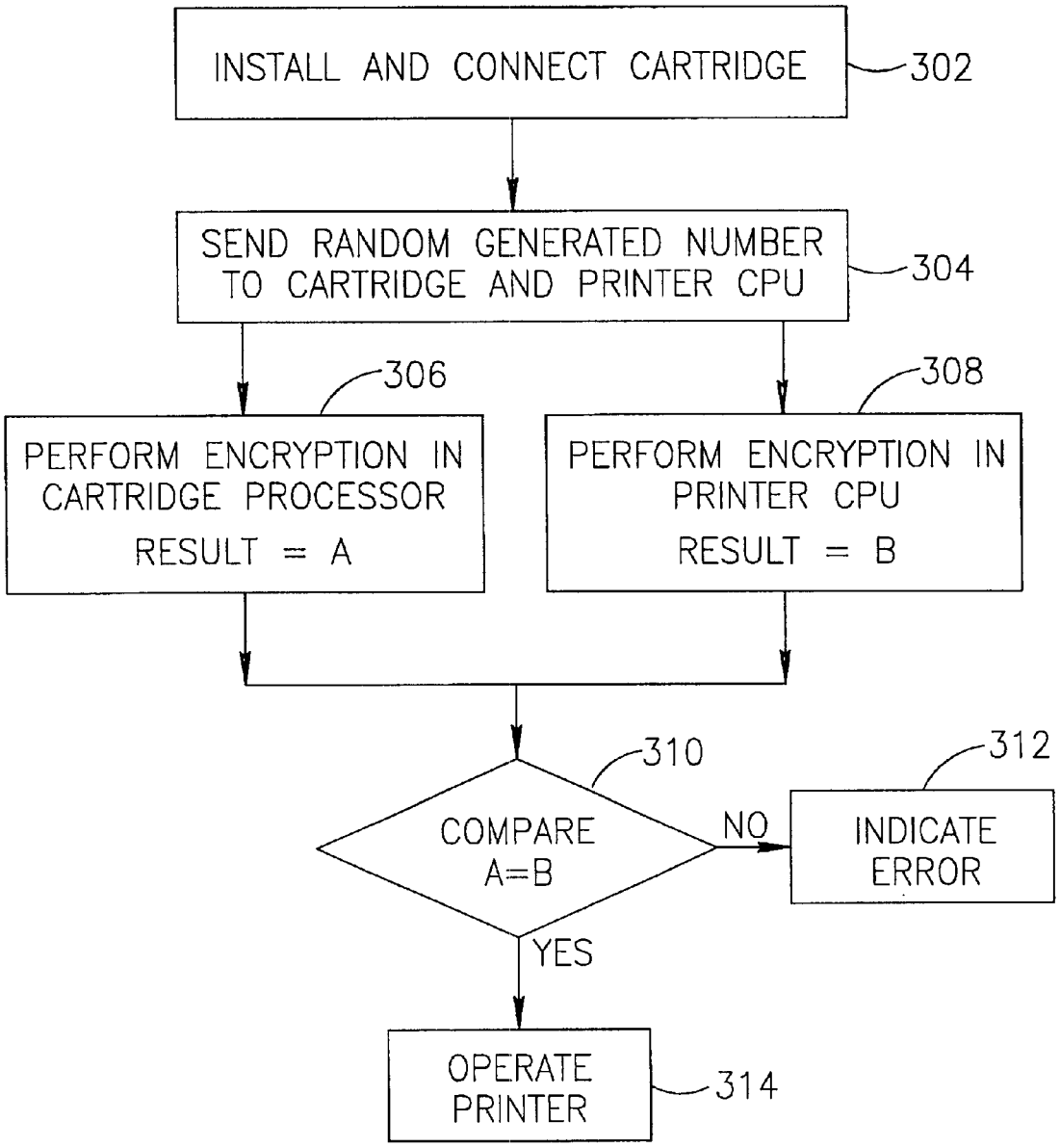
FIG. 9 is a flow chart illustration of the method for detecting a genuine ink cartridge.

Reference is now also made to FIG. 9 which is a flow chart illustration of the method for detecting a genuine manufacturer supplied ink cartridge and preventing the use of a non-genuine cartridge.

The cartridge unit 200 is installed and coupled to the CPU 208 in the printer (step 302). CPU 208 sends a randomly generated number ("code") to the cartridge processing unit 210 (step 304). The "code" is used by the processing unit 210 for encryption (step 306). Concurrently, the CPU 208 also performs the encryption algorithm utilizing the same "code" (step 308).

A comparison between the two encrypted results is made (query box 310). If the resulting encryptions are not identical, the printer indicates an error (step 312), The printer will only operate if the calculations are identical (step 314).

It will be appreciated that the present invention is not limited by what has been described hereinabove and that numerous modifications, all of which fall within the scope of the present invention, exist. For example, while the present invention has been described with respect to a replaceable ink cartridge for use in a ink-jet printer, the invention is also applicable for use with other consumable items.

It will be appreciated by persons skilled in the art that the present invention is not limited by what has been particularly shown and described herein above. Rather the scope of the invention is defined by the claims which follow:

What is claimed is:

1. An ink cartridge comprising:

a rigid housing; and a flexible ink storage bag substantially enclosed by said rigid housing but not fixedly attached thereto, said flexible ink storage bag collapsible as ink is drawn therefrom, wherein said ink cartridge is connectable to an ink supply line of a printer having a hollow needle, said needle punctures a wall of said storage bag through an outlet port of said housing when said storage bag is substantially full of ink wherein said storage bag cannot be refilled by said hollow needle or similar needle when said storage bag is substantially depleted of ink.

2. An ink cartridge according to claim 1, wherein said housing comprises upper and lower chambers permanently connected together around said flexible ink storage bag.

3. An ink cartridge according to claim 1 and wherein said hollow needle comprises an angled sealed point formed in one end thereof.

4. An ink cartridge according to claim 1 and further comprising a metal element placed on top of said ink storage bag, said metal element descending as said ink storage bag is emptied.

5. An ink cartridge according to claim 4 wherein said metal element comprises an annulus formed therein.

6. An ink cartridge according to claim 4 wherein said metal element is composed of a ferrous material.

7. An ink cartridge according to claim 6 wherein said printer comprises a magnetic sensor proximate to the bottom of said lower chamber for sensing the presence of said ferrous metal element thereby to indicate the depletion of said storage bag.

8. An ink cartridge according to claim 1 and further comprising an indicator representing a logo attached to the exterior face of said housing.

9. An ink cartridge according to claim 8 wherein said indicator is composed of conductive material responsive to electro-magnetic fields.

10. An ink cartridge according to claim 9 wherein said printer comprises a detector for detecting the form of said indicator.

11. An ink cartridge according to claim 8 wherein said indicator is a relief with a negative built into a housing of the printer.

12. An ink cartridge according to claim 1 and further comprising a processing unit which may be coupled to the central processing unit of said printer.

* * * * *

UNITED STATES PATENT AND TRADEMARK OFFICE

CERTIFICATE OF CORRECTION

PATENT NO. : 6,511,142 B1
DATED : January 28, 2003
INVENTOR(S) : Carmon, Amiram et al.

It is certified that error appears in the above-identified patent and that said Letters Patent is hereby corrected as shown below:

Title page,
Item [86], please change to:
-- PCT No.: PCT/IL98/00399 --

Signed and Sealed this

Seventh Day of October, 2003

JAMES E. ROGAN
*Director of the United States Patent and Trademark Office*